United States Patent [19]

Zboralski

[11] 4,399,740

[45] Aug. 23, 1983

[54] FUME HOOD WITH DUAL ROOM AIR INLET SYSTEMS

[75] Inventor: Jon A. Zboralski, Manitowoc, Wis.

[73] Assignee: Hamilton Industries, Inc., Two Rivers, Wis.

[21] Appl. No.: 103,663

[22] Filed: Dec. 14, 1979

[51] Int. Cl.[3] ..... F23J 11/00

[52] U.S. Cl. ..... 98/115 LH; 137/607

[58] Field of Search ..... 98/115 R, 115 LH, 115 VM, 98/116; 137/607; 126/287; 110/158; 49/95, 96, 100; 160/222, 223; 55/419, DIG. 36

[56] References Cited

U.S. PATENT DOCUMENTS

| | | | |
|---|---|---|---|
| 1,063,619 | 6/1913 | Thomson | 126/287 |
| 1,479,339 | 1/1924 | Torgerson | 49/69 X |
| 2,715,359 | 8/1955 | Mackintosh et al. | 98/115 LH |
| 3,111,077 | 11/1963 | Cortright | 98/115 LH |
| 3,604,333 | 9/1971 | Nelson | 98/115 LH |
| 3,752,056 | 8/1973 | Chamberlin et al. | 98/115 LH |
| 4,023,433 | 5/1977 | Russell | 98/115 LH |
| 4,142,458 | 3/1979 | Duym | 98/115 LH |
| 4,177,718 | 12/1979 | Grow et al. | 98/115 LH |

*Primary Examiner*—Albert J. Makay
*Assistant Examiner*—Harold Joyce
*Attorney, Agent, or Firm*—Tilton, Fallon, Lungmus

[57] ABSTRACT

A laboratory fume hood with a horizontally slidable sash that is operatively coupled to and actuates a laterally movable damper in a manner inverse to sash movement. As the sash opens, the damper closes. Conversely, as the sash closes, the damper opens.

5 Claims, 9 Drawing Figures

FUME HOOD WITH DUAL ROOM AIR INLET SYSTEMS

BACKGROUND

U.S. Pat. No. 2,715,359 describes a fume hood with a laterally slidable sash. A room air vent is shown directly below this sash, and air flow through the room air vent is controlled by the *vertically* movable damper as shown in FIG. 4. The vertically movable damper is actuated by the horizontal sash movement through a complicated linkage of sprockets, chains, and counterweights. Any slippage of the sprocket could cause the damper to bind in the tracks at each end of the damper.

U.S. Pat. No. 3,604,333 also shows a fume hood with a horizontally slidable sash connected to dampers 26*a*, 26*b*, and 26*c* directly above the sash. These dampers control the flow of auxiliary air, not room air. Also, these dampers operate in direct relationship with the sash. When the sash is open, the damper is open; and conversely, when the sash is closed, the damper is closed. Because of this direct relationship of movement between the horizontally movable sash and the horizontally movable damper, a complicated duct work is needed for handling the auxiliary air. This is noted by the expensive duct work and housing behind the dampers, as well as in front of the dampers. There is no showing that the dampers in this patent have anything to do with the vent of room air directly into the hood.

SUMMARY OF THE INVENTION

The present invention overcomes the above problems with actuating a room air vent damper with a horizontally slidable sash. The fume hood of the present invention includes a laterally movable damper operatively connected to the horizontally slidable sash in a manner such that as the sash opens, the sash moves the damper toward a closed position. As the sash closes, the coupling between the sash and damper moves the damper to an open position. Thus, the sash actuates the damper in an inverse manner from movement of the sash.

RELATED APPLICATIONS

The following are co-pending, co-owned patent applications. "Method of Controlling Room Air Flow Into A Fume Hood," filed Dec. 14, 1979, Ser. No. 103,664, Zboralski; "Horizontal Sash Fume Hood With Auxiliary Air Control," filed Dec. 14, 1979, Ser. No. 103,665, Zboralski; and "Method of Controlling Auxiliary Air In Horizontal Sash Fume Hood," filed Dec. 14, 1979, Ser. No. 103,666 now abandoned, Zboralski.

THE DRAWINGS

DETAILED DESCRIPTION

Figure 1:
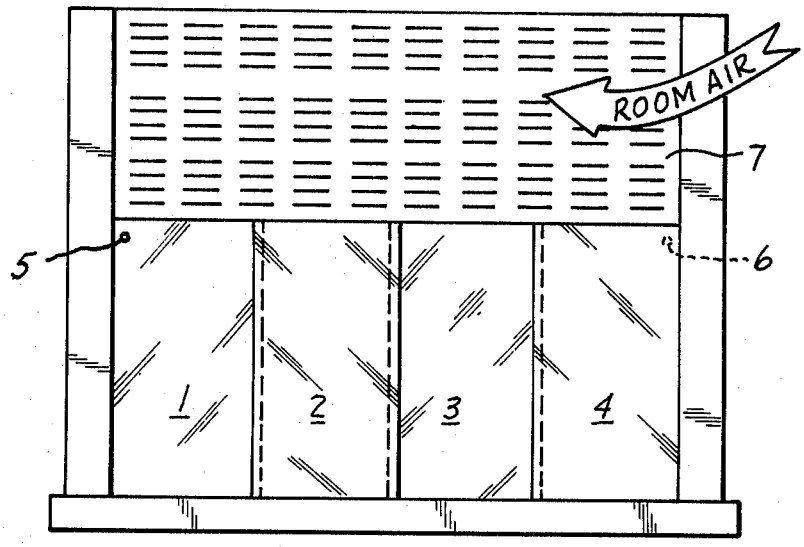
FIG. 1 is a front elevational view of a first embodiment of the fume hood having four sash panels and having the room air vent grill attached.
Figure 3:
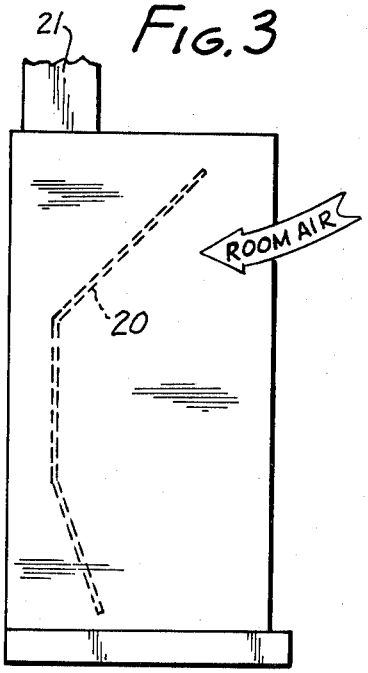
FIG. 3 is a schematic left end view of the fume hood of FIG. 2 showing the entrance of room air.

The first embodiment of the fume hood shown in FIG. 1 includes four horizontally slidable sash panels designated as 1, 2, 3, and 4. These panels are preferably made of transparent glass, but for clarity dotted lines have been used to show the overlapping relationship between the sash panels. In FIG. 1, sash panels 2 and 4 are located in front of sash panels 1 and 3. Panel 1 has a forwardly protruding stop button 5 adjacent its left edge to prevent sash panel 1 from sliding to the right and assuming the position of sash panel 2 while sash panel 2 slides to the left and assumes the position of sash panel 1. As will be explained later, movement of the sash panels control room air vent dampers, and thus, it is important to maintain their positions relative to each other. Sash panel 4 also has a stop button 6 protruding rearwardly from it to control the relationshp between sash panels 3 and 4. Preferably, the stop buttons 5 and 6 would be located above the glass panels on a metal supporting structure, and not visible in the view of FIG. 1. However, for clarity, they have been shown on the sash panels in a visible location.

Figure 2:
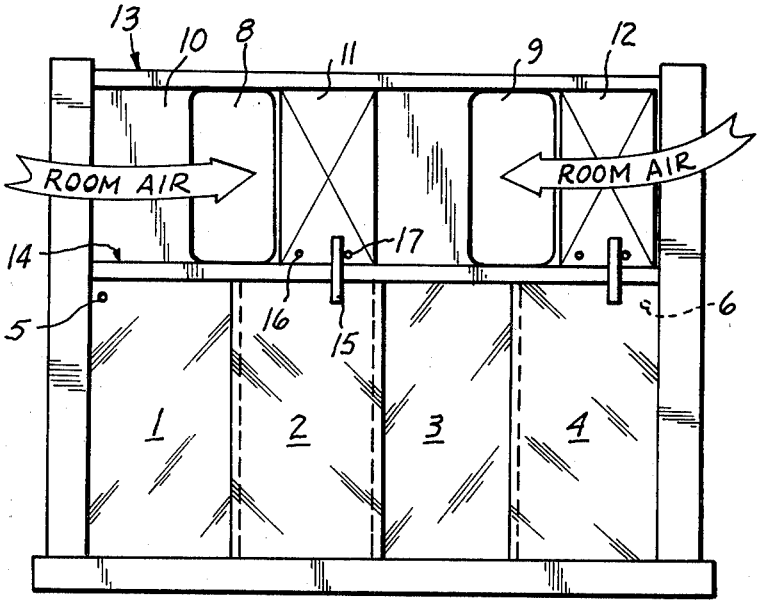
FIG. 2 is a front elevational view of the fume hood of FIG. 1 with the room air vent grill removed and showing the damper position with all sash panels closed.

In FIG. 2, the room air vent grill 7 has been removed to expose room air vents 8 and 9 and a wall panel 10. Horizontally sliding damper panels 11 and 12 slide in a track system noted generally as 13 and 14. Preferably, damper panels 11 and 12 have rollers adjacent their lower edges for riding in track 14.

Panel 2 has at its upper edge a bar member 15 that is located between abutment members 16 and 17 on panel 11. Because abutment members 16 and 17 are laterally spaced apart, bar member 15 and sash panel 2 can travel a given horizontal distance before moving damper panel 11. This permits the sash panel 2, which is wider than damper panel 11, to open and close their respective sash and vent openings.

Figure 5:
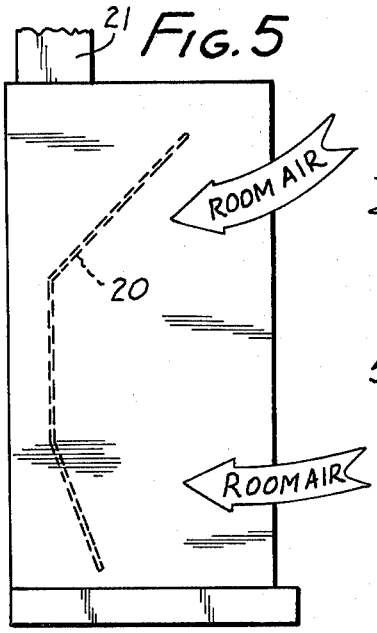
FIG. 5 is a schematic left end elevational view of the fume hood of FIG. 4 showing how room air enters the hood.
Figure 4:
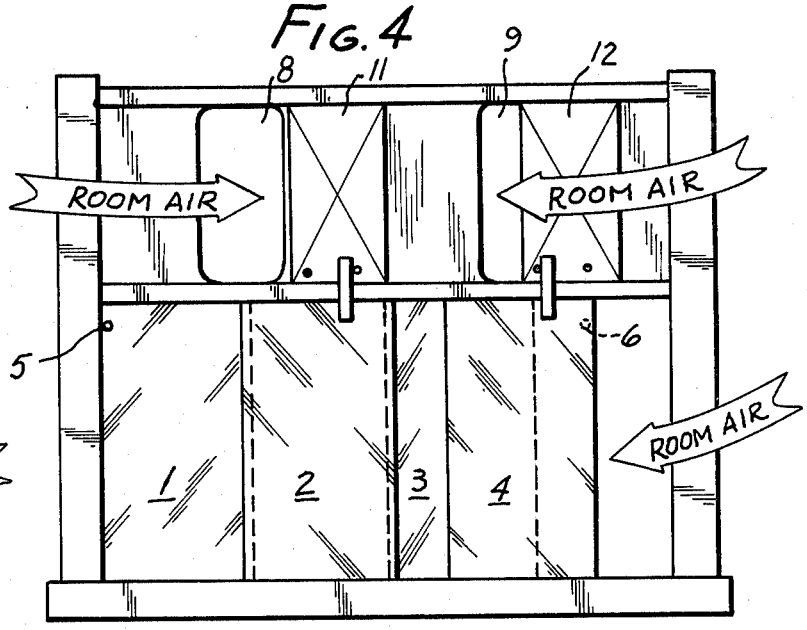
FIG. 4 is a front elevational view of the fume hood showing the right end sash panel partially open.

In FIG. 4, the sash panel 4 has been moved to the left to partially open the sash. This causes the damper panel 12 to partially close vent opening 9. FIG. 5 shows the schematic flow of room air. The dotted lines 20 in the fume hood schematically depicts a typical baffle system, while exhaust 21 shows a typical duct segment for sucking air out of the fume hood.

Figure 7:
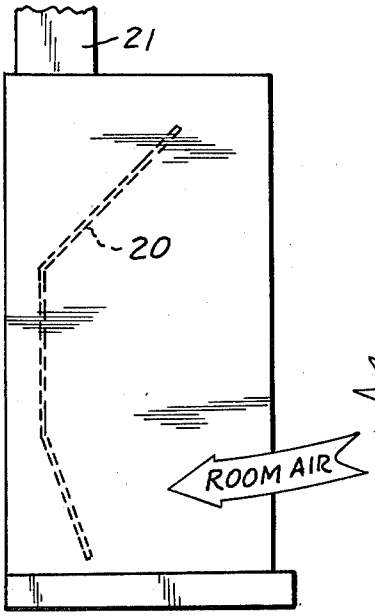
FIG. 7 is a schematic view of the left end elevational view of the fume hood of FIG. 6.
Figure 6:
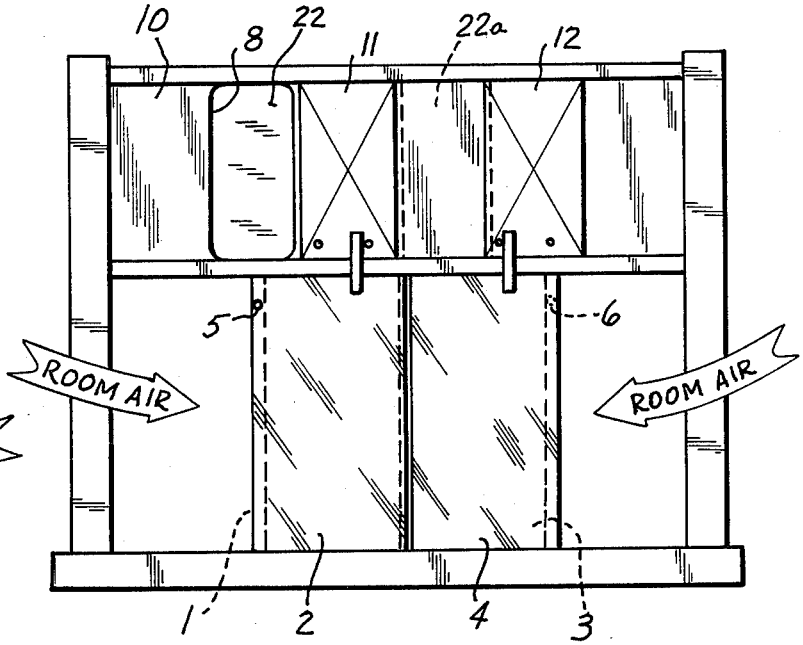
FIG. 6 is a front elevational view of the fume hood showing the left and right end sashes open.

In FIG. 6, the left and right end sashes 1 and 4 are completely open. In this view the function of stop buttons 5 and 6 can be appreciated. When the sash panels are in the positions shown in FIG. 6, a damper panel 22 on the rear side of wall panel 10 closes off vent passage 8. Also, damper panel 12 closes off vent passage 9. A damper panel 22*a* is shown in dotted line at a rear wall panel 10. Since both room air vents are completely closed, all room air must enter through the open sashes. This is schematically depicted in FIG. 7.

Figure 8:
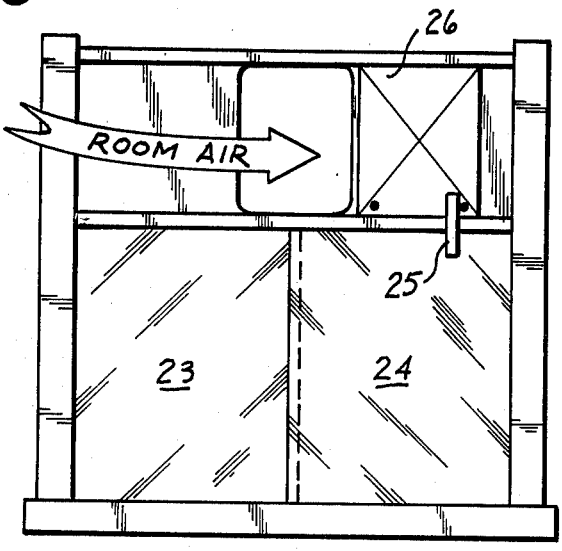
FIG. 8 is a front elevational view of a second embodiment of the fume hood with two sash panels.

In FIG. 8, a second embodiment of the invention is shown which has two sash panels 23 and 24. As with the first embodiment, panel 24 has a bar member 25 that laterally moves damper panel 26. In this second embodiment, a fume hood with two sash panels might be approximately 4 feet wide, while in the first embodiment the fume hood might be approximately 6 feet wide. However, it is understood that any number of sash panels and any width of fume hood could be constructed if desired.

Figure 9:
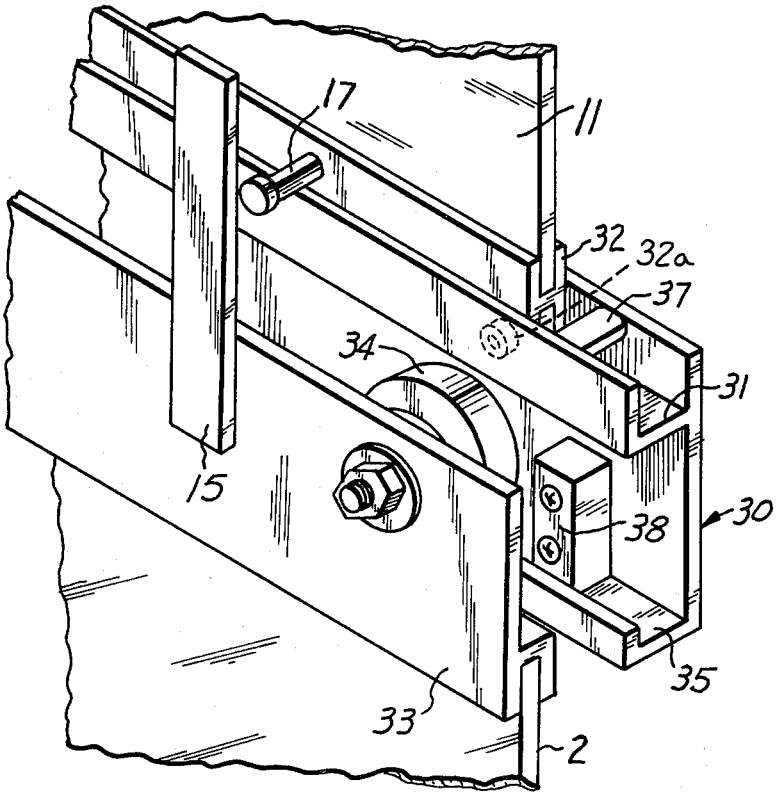
FIG. 9 is a fragmentary perspective of the operative connecting structure between the horizontal slidable sash and the damper.

The relationship between the panel 2 and damper panel 11 is shown in the fragmentary prospective view of FIG. 9. A track system shown generally at 30 includes an upper track 31 to receive damper 11. Preferably, a bottom rail 32 on damper 11 includes rollers (one of which is shown in dotted line as 32*a*) along its bottom. A rail 33 along the top edge of sash panel 2 includes a roller 34 that rides in lower track 35. The precise roller configuration and track profile can be modified as desired. Preferably, the lower track is generally V-shaped for centering the roller. As V-shaped tracks are well-known, it was not believed necessary to show such details. Likewise, the rollers (not shown) of the damper panel could be centrally grooved and upper track 31 provided with an upstanding rib for engaging such groove roller and centering it. Groove rollers are also well-known so it was not believed necessary to show such detail.

As the sash panel 2 moves horizontally, the upstanding bar member 15 engages abutment member 17. Preferably, abutment member 17 has an outer cushion, such as a tubular collar on a threaded screw, for absorbing shock of impact between bar member 15 and abutment member 17. A stop member 37 in the upper track prevents excessive horizontal movement of the damper panel 11. Also, a stop member 38 in the lower track prevents excessive movement of the sash panel 2.

In the foregoing description, specific examples have been used to describe the invention. However, it is understood by those skilled in the art that certain modifications can be made to these examples without departing from the spirit and scope of the invention.

I claim:

1. A fume hood comprising: a housing with a horizontally slidable sash and a room air vent located directly above the sash; a horizontally slidable damper for altering room air flow through the vent; a pair of laterally spaced abutment members on one of the sash and damper; and a bar member on the other of the sash and damper located between the abutment members, so that the sash can horizontally travel a greater distance than the damper but still move the damper in response to movement of the sash, such abutment members and bar member being engageable so as to transmit at least a portion of movements to the left and a portion of movements to the right of the sash into lateral movements of the damper.

2. A fume hood as set forth in claim 1, wherein the abutment member and bar member have engaging structures causing the sash opening to be altered inversely to the vent opening.

3. A fume hood comprising: a housing with a horizontally movable sash and a room air vent; a laterally movable damper for altering room air flow through the vent; and structural means operatively connecting the horizontally movable sash and the laterally movable damper for changing the vent in an inverse manner to changes in the sash, said structural means being capable of transmitting at least a portion of sash movements to the left and at least a portion of sash movements to the right into lateral movements of the damper, wherein the structural means has engageable portions permitting the sash to travel a given horizontal distance before moving the damper, whereby the total travel of the sash is greater than the damper travel to accommodate a sash wider than the damper.

4. A fume hood as set forth in claim 3, wherein there is a bar member on one of the sash and damper that moves between two laterally spaced abutment members on the other of the sash and damper.

5. A fume hood as set forth in claim 4, wherein the bar member is on the sash and the abutment members are on the damper.

* * * * *